United States Patent [19]

Butler et al.

[11] 4,158,114

[45] Jun. 12, 1979

[54] ROTARY SWITCHING DEVICE

[76] Inventors: David Butler; Frank Cichanski, both of 5243 S. Cicero, Chicago, Ill. 60638

[21] Appl. No.: 821,723

[22] Filed: Aug. 4, 1977

[51] Int. Cl.[2] ..... H01H 9/00; H01H 21/76

[52] U.S. Cl. ..... 200/1 R; 200/5 R; 200/11 R; 200/11 G; 200/14

[58] Field of Search ..... 200/11 R, 11 G, 11 J, 200/11 K, 11 TW, 14, 1 R, 5 R

[56] References Cited

U.S. PATENT DOCUMENTS

| | | | |
|---|---|---|---|
| 2,144,139 | 1/1939 | Batcheller | 200/11 G X |
| 2,210,842 | 8/1940 | Schellenger | 200/11 G |
| 2,644,045 | 6/1953 | Herterick | 200/14 X |
| 3,005,881 | 10/1961 | Ellsworth | 200/11 TW |
| 3,132,216 | 5/1964 | Adams | 200/11 TW |
| 3,284,583 | 11/1966 | Buzzi | 200/11 TW |
| 3,499,127 | 3/1970 | Cherry et al. | 200/11 TW X |
| 3,772,485 | 11/1973 | Workings | 200/11 TW |

*Primary Examiner*—James R. Scott

*Attorney, Agent, or Firm*—Laff, Whitesel & Rockman

[57] ABSTRACT

A switching device is provided which permits connection of two incompatibly wired electrical components. The electrical signal from each lead on the first electrical component is isolated on a particular switch assembly and re-routed along a selected path to a desired terminal, which then feeds the signal to a particular lead on the second electrical component. Each switch assembly operates independently of the other switch levels, thereby permitting any combination of electrical routes or paths to be selected and accommodating a great variety of wiring designs.

17 Claims, 5 Drawing Figures

ROTARY SWITCHING DEVICE

BACKGROUND OF THE INVENTION

This invention relates to switching matrix devices and, more particularly, to a rotary switching device for use with communication components which are incompatibly wired for mutual use.

A common problem has arisen in today's market for communication devices or the like where the electrical component of one manufacturer is wired to permit use only with a component of the same manufacturer. An illustration is the citizen's band (CB) radio industry, where microphones of one manufacturer are often wired in a different manner or with a different configuration than the radios of another manufacturer. This tends to restrict the consumer to purchasing microphones and radios of the same manufacturer, even though the microphone of another manufacturer may have other, more desirable features.

One solution to this problem has been for the consumer to have one component re-wired to make it compatible with the other component. This usually requires the consumer to bring his or her components to a radio shop or to an electrician, but the labor costs and inconvenience discourage this practice. Another solution has been to purchase a switching device, which is usually simply a pre-wired adapter, to accommodate the different wiring of the two components, but these devices are useful only for adapting a particular wiring design to another particular wiring design. If, for example, the consumer later purchases a microphone of a third manufacturer, another switching device must be purchased. Since electrical components are constantly changing and consumers often upgrade one or more components several times, there is a need for an inexpensive switching device which is adaptable to a variety of wiring designs.

SUMMARY OF THE INVENTION

Accordingly, an object of this invention is to provide a new and improved switching device. A more particular object is to provide a switching matrix which can adapt to a variety of wiring designs and especially to the vast majority of wiring designs presently on the market for CB radios and microphones. Yet another object is to provide a rotary switching device employing circuit-board technology which is compact, simple to operate, inexpensive to construct and can be modified when necessary by the consumer to accommodate an even greater variety of wiring designs.

In keeping with one aspect of this invention, a rotary switching device is coupled with two electrcial components having leads wired incompatibly. Bus pin conductors carry the electrical signals from the components through terminals located at each switch assembly within the switching device. The switch assemblies are each independently adjusted by moving the position selectors to indicated positions, thereby connecting designated input terminals with certain output terminals. The re-routing of the electrical signals at each switch assembly in effect "re-wires" one electrical component to make it compatible with the other electrical component.

The above mentioned and other features of this invention and the manner of obtaining them will become more apparent, and the invention itself will be best understood by reference to the following description of an embodiment of the invention taken in conjunction with the accompanying drawings, in which:

DESCRIPTION OF THE PREFERRED EMBODIMENT

Figure 1:
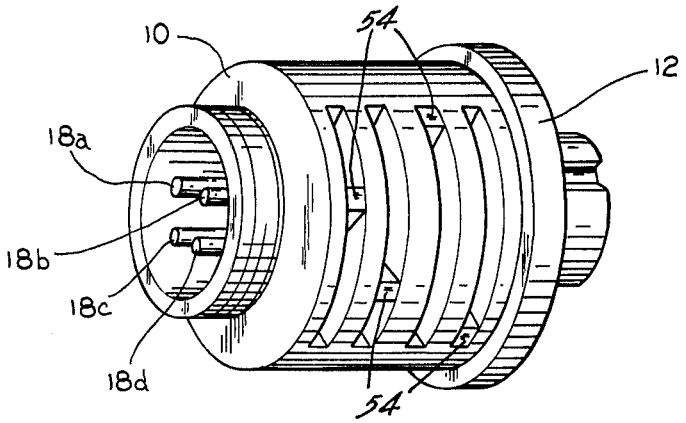
FIG. 1 is a perspective view of a rotary switching device according to this invention.
Figure 2:
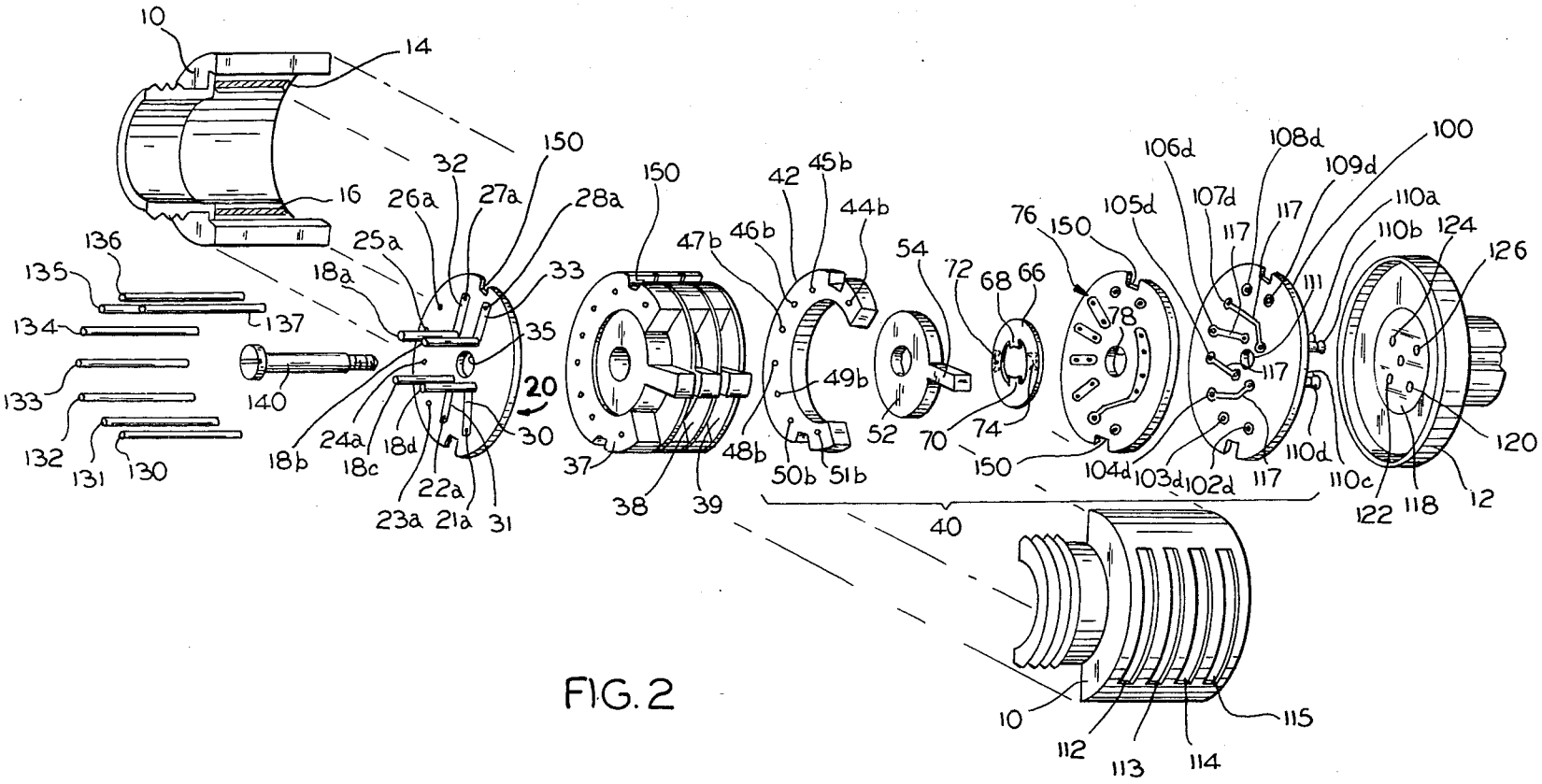
FIG. 2 is an exploded view of a rotary switching device according to this invention.

As shown in FIGS. 1 and 2, a rotary switching device constructed in accordance with the teachings of this invention comprises a housing 10 terminating at one end with a housing cap 12. The housing 10 has a pair of flanges 14 and 16 extending internally for most of the length of housing. Protruding out one end of the housing 10 are four prongs or contacts 18*a*, 18*b*, 18*c*, and 18*d* to engage a first electrical device or component, such as a microphone (not shown). Four prongs in a generally square configuration are used for illustration purposes only, since this is a common number and configuration for CB radios and microphones. However, this invention is not limited to use with components having this number or configuration of prongs, nor is it limited to the use of prongs to engage the electrical components; any sort of electrical contacts for permanent or temporary connection with an electrical component is within the scope of this invention.

The prongs 18*a*, 18*b*, 18*c*, and 18*d* are fixed to a first end plate 20 composed of a non-conductive material such as phenolic resin. Along the circumference of end plate 20 are a plurality of terminals 21*a*, 22*a*, 23*a*, 24*a*, 25*a*, 26*a*, 27*a*, and 28*a*, preferably spaced 30 degrees apart. These terminals are apertures plated through with conductive material such as copper. Four of the terminals, 21*a*, 22*a*, 27*a*, and 28*a*, are connected to prongs 18*a*, 18*b*, 18*c*, and 18*d* by conductive routing means 30, 31, 32, and 33, respectively. The routing means can be any conductive material, such as copper. Terminals 21*a*, 22*a*, 27*a*, and 28*a* will be referred to as input terminals because the electrical signal from the first electrical component is received there, while terminals 23*a*, 24*a*, 25*a*, and 26*a* will be referred to as output terminals, since the signal leaves the first end plate through these terminals. Aperture 35 extends through the center of first end plate 20.

Adjacent the first end plate are a plurality of switch assemblies 37, 38, 39, and 40. Four switch levels are shown by way of example because a four pronged end plate has been shown in the drawing to accommodate an electrical component with four leads. The invention provides switch assemblies at least equal in number to the number of leads on the electrical components carrying separate electrical signals and, consequently, equal to the number of contacts provided on the first end plate.

Switch assembly 40 has been exploded in FIG. 2 to show its respective elements. Spacer 42 is a crescent shaped piece of non-conductive material, such as plastic, of approximately the same diameter as first end plate 20. Spacer 42 has eight eyelets or apertures 44*b*, 45*b*, 46*b*, 47*b*, 48*b*, 49*b*, 50*b*, and 51*b* along its circumference coincident to terminals 21*a* through 28*a* in first end plate 20. These eyelets are not plated through with conductive material.

Figure 4:
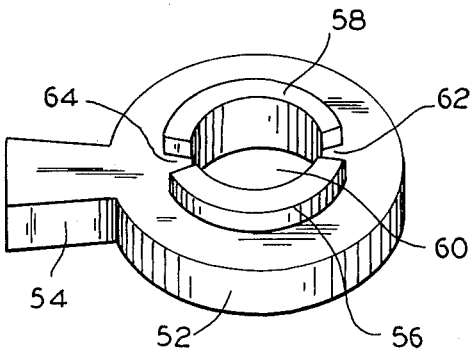
FIG. 4 is a perspective view of a position selector from a switch level.

Position selector 52 is a doughnut shaped piece of non-conductive material with a handle portion 54 extending radially out from the edge. Position selector 52 fits within the crescent portion of spacer 42, and can be rotated within the spacer by moving handle 54. The handle of each position selector preferably extends through one of four slots 112, 113, 114, and 115 in the wall of housing 10. The side of position selector 52 reverse from that illustrated in FIG. 2 is shown in FIG. 4. On this reverse side two upraised, crescent shaped flanges 56 and 58 partially surround central aperture 60 in position selector 52. Between these flanges are slots 62 and 64.

Figure 5:
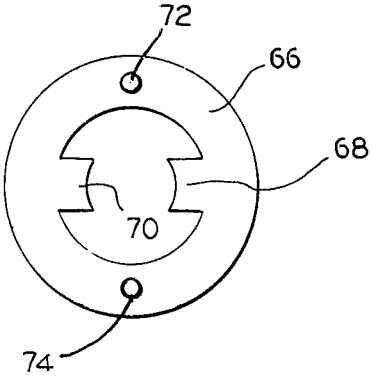
FIG. 5 is a plan view of a wiper from a switch level.

Spring wiper 66 is fixed to this reverse side of position selector 52. Spring wiper 66, which is best shown in FIGS. 2 and 5, is also doughnut shaped, but it is composed of a conductive material having a limited amount of elasticity. Flanges 68 and 70 of wiper 66 extend radially in toward the center of the wiper and are adapted to force fit into slots 62 and 64 of position selector 52. In this manner wiper 66 rides on flanges 58 and 60 and is fixed to position selector 52. Two diametrically opposed indentations 72 and 74 protrude up from the wiper.

Figure 3:
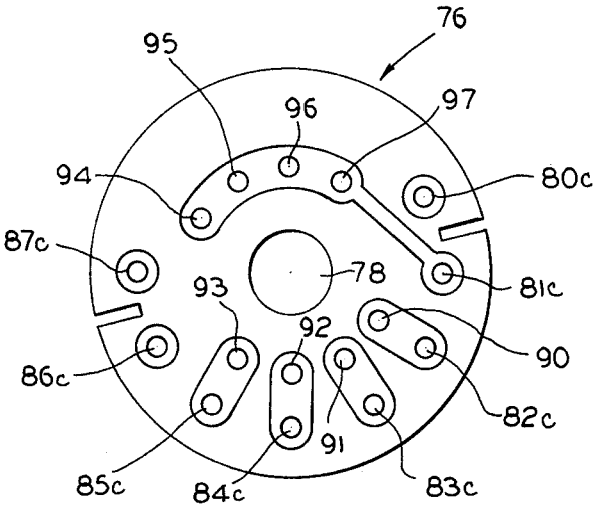
FIG. 3 is a plan view of the wafer element in a switch assembly.

Wafer or fixed contact assembly 76 is also an element of switch assembly 40, as shown in FIGS. 2 and 3. The wafer is a circular piece of non-conductive material, such as phenolic resin, having an aperture 78 in the center. Wafer 76 also has eight terminals 80*c*, 81*c*, 82*c*, 83*c*, 84*c*, 85*c*, 86*c* and 87*c* similar to those in fist end plate 20 and coincident thereto. Terminals 80*c*, 81*c*, 86*c* and 87*c* are input terminals and 82*c*, 83*c*, 84*c* and 85*c* are output terminals. Conductively paired with each output terminal are output detents 90, 91, 92 and 93, respectively, which are deformed conductive areas having discrete conductive paths associated with the output terminals. Opposite aperture 78 from the output detents are input detents 94, 95, 96 and 97 which are deformed conductive areas. Both the input and output detents are adapted to engage indentations 72 and 74 of wiper 66, and are spaced apart so that one indentations can engage an input detent while the other knob engages an oppositely positioned output detent. The input detents are conductively connected in series to each other and to a single input terminal on the wafer. In the drawings, input terminal 81*c* is connected to the input detents by conductive routing means similar to that on first end plate 20, but the wafer in each switch assembly has a different input terminal connected to the series of input detents. Thus, one wafer is provided where each input terminal 80*c*, 81*c*, 86*c*, and 87*c* is connected to the series of input detents. In all other respects, each switch assembly is identical to the others.

A second end plate 100 is positioned adjacent the last switch assembly. The second end plate is similar in size and material to first end plate 20, and it also has four input terminals 102*d*, 103*d*, 108*d* and 109*d*, and four output terminals 104*d*, 105*d*, 106*d* and 107*d*. These terminals are plated through with conductive material such as copper. The output terminals are connected by conductive routing means 117 to four contacts, shown as tubular, pin-socket pieces 110*a*, 110*b*, 110*c*, and 110*d* projecting perpendicularly from one side of second end plate 100. The pin-socket pieces are conductive and are adapted to receive the leads of a second electrical component. A central aperture 111 is provided in the center of the end plate.

Preferably, the pin-socket pieces are fixed within and supported by a non-conductive, cylindrical pin-guide insert 118 having apertures 120, 122, 124 and 126 to receive the pin-socket pieces. The pin-guide insert is desirably enclosed by housing cap 12 which terminates from housing 10. A second electrical component can be plugged directly into the housing cap and thereby connect with the pin-socket pieces.

To conductively transmit electrical signals from the contacts on the first end plate through the switch assemblies to the pin-socket pieces on the second end plate, eight bus pin conductors 130, 131, 132, 133, 134, 135, 136, and 137 are provided. These bus pin conductors extend through the terminals and eyelets in the end plates and switch assemblies. Thus, coincidental terminals on the respective wafers and end plates are conductively connected by these transmission means. Desirably, the bus pin conductors have one or more ribs extending along their length to allow a force-fit with the terminals and eyelets.

A central axis screw 140 desirably extends through apertures centrally located in the end plates and switch levels. The screw is anchored in pin-guide insert 118.

To provide additional rigidity within the housing, the end plates, spacers and wafers are provided along their circumferences with diametrically opposed grooves, collectively referred to as 150. The grooves 150 engage flanges 14 and 16 along the inside wall of housing 10 and hold the elements of the switching device rigid while permitting only the position selectors and wipers to rotate within the housing.

The switching device is easy to operate and use. The various position selectors, which can be color coded to distinguish them, are each rotated to prescribed positions preferably indicated along the slots on the housing. This locates the position selector in each switch assembly so that its knobs are engaged within an input detent and a particular output element. Since, for any single switch assembly, all of the input detents are connected to a single designated input terminal, one input terminal can be connected with any of four output terminals. Each switch assembly can be set to route the electrical signal from the designated input terminal to an output terminal the same as or different from the other switch assemblies, in accordance with the requirements of the particular electrical components to be connected. Each switch assembly operates independently of the other switch assemblies and is, therefore, "non-blocking". The device is then merely interposed between and plugged into the two electrical components. The components are then compatibly "re-wired".

The embodiment shown in the drawings is designed to accommodate approximately 90% of the CB radios and microphones presently on the United States market. To accommodate nearly all of the remaining CB radios and microphones currently sold, some of which have up to six conductive leads, the number of contacts and pin socket pieces on the end plates, the number of switch assemblies, and the number of detents on the wafers can be increased to six, while the number of bus pin conductors, terminals and eyelets are increased to twelve, spaced approximately 20 degrees apart. In addition, the end plates can be replaced with end plates having contacts in a variety of configurations other than the generally square configuration shown. With these slight modifications, all of the variations in wiring designs and configurations for a six lead electrical component can be accommodated.

Of course, the invention is not limited to use with CB radios and microphones. The invention is particularly suitable to a variety of communication devices such as amplifiers, speakers and other types of radios, but it can also be used to adapt any two electrical components wired incompatibly. Any number of switch assemblies or configurations of the contacts on the end plates can be used.

The many advantages of this switching device are self-apparent. The parts are easily and inexpensively made, and modern circuit-board technology can be used rather than the clumsy and bulky wires of previous adapters. The device is readily adaptable to a variety wiring designs, and, with a minimum amount of modification, can be easily made to accommodate different numbers or configurations of leads from electrical components. Of course, there are still other advantages apparent to those skilled in the art.

While the principles of the invention have been described above in connection with specific apparatus and applications, it is to be understood that this description is made only by way of example and not as a limitation on the scope of the invention.

We claim:

1. A switching matrix for selectively interconnecting electrical components, said switching matrix comprising: a housing; coupling means terminating from each end of said housing for conducting electrical signals to and from said electrical components; and a plurality of independently operable multiposition switch assemblies between said coupling means, each of said switch assemblies including a plurality of input terminals and plurality of output terminals, transmission means connecting said terminals for conducting electrical signals between the switch assemblies and to the coupling means, routing means associated with each switch assembly for conducting electrical signals from a designated input terminal to a selected output terminal, and movable contact means for selectively and individually adjusting each of said switch assemblies to direct the electrical signal between a desired input terminal and a desired output terminal, such that each switch assembly can direct the electrical signal from the designated input terminal to any output terminal to provide a combination of possible pathways for the electrical signal through the matrix depending on the setting of each assembly.

2. A switching matrix according to claim 1, wherein the switch assemblies include a spacer having eyelets extending through it permitting passage of the transmission means for conducting the electrical signal between the various switch assemblies and to the coupling means.

3. A switching device according to claim 2, wherein said movable contact means for adjusting each of said switch assemblies to direct the electrical signal between a desired input terminal and a desired output terminal comprise a movable position selector partially enclosed by said spacer and a conductive wiper fixed to said position selector for transmitting the electrical signal between said terminals.

4. A switching matrix according to claim 2, wherein the switch assemblies also each comprise a fixed contact assembly adjacent to said spacer including said input and output terminals coincident to the eyelets in said spacer and input and output conductive areas, said input areas conductively connected to one of said input terminals and said output areas each conductively paired with said output terminals, whereby said input terminals receive the electrical signal from said transmission means and said output terminals transmit the electrical signal to said transmission means.

5. A switching matrix according to claim 4, wherein said movable contact means for adjusting each of said switch assemblies to direct the electrical signal between a desired input terminal and a desired output terminal comprise a movable position selector partially enclosed by said spacer and a conductive wiper fixed to said position selector and adjacent said fixed contact assembly, said wiper having a pair of indentations adapted to sit within an input area and an output area on said fixed contact assembly so as to transmit the electrical signal between them.

6. A switching matrix according to claim 1, wherein the switch assemblies each comprise a fixed contact assembly including said input and output terminals and input and output conductive areas, said input areas conductively connected to one of said input terminals and said output areas each conductively paired with said output terminals, whereby said input terminals receive the electrical signal from said transmission means and said output terminals transmit the electrical signal to said transmission means.

7. A switching matrix according to claim 6, wherein said movable contact means for adjusting each of the switch means to direct the electrical signal between a desired input and a desired output terminal comprise a movable position selector and a conductive wiper fixed to said position selector adjacent said fixed contact assembly, said wiper having a pair of indentations adapted to sit within an input area and an output area on said fixed contact assembly so as to transmit the electrical signal between them.

8. A switching matrix according to claim 1, wherein said movable contact means for adjusting each of said switch assemblies to direct the electrical signal between a desired input and a desired output terminal comprise a movable position selector and a conductive wiper fixed to said position selector which transmits the electrical signal between the input and output terminals.

9. A switching matrix according to claim 1 wherein said coupling means for conducting the electrical signal to and from said communication devices comprises: a pair of end plates on either side of the plurality of switch assemblies a plurality of conductive input and output terminals fixed in the first end plate; a plurality of electrical contacts fixed to said first end plate each conductively connected to an input terminal; a plurality of conductive input and output terminals fixed to the second end plate coincident with the terminals in said first end plate; and a plurality of electrical contacts fixed to said second end plate, each conductively connected to an output terminal of said second end plate.

10. A switching matrix according to claim 1 wherein said transmission means for conducting said electrical signal between the various switch assemblies and to the coupling means comprises a plurality of bus pin conductors extending through the coincidental input and output terminals and eyelets in said switch assemblies and said coupling means.

11. A rotary switching device permitting connection of a first communication device adapted to receive conductive pins with a second communication device having conductive leads wired incompatibly with the first communication device, comprising:

(a) a housing;

(b) a first end plate contained within said housing having a plurality of conductive input and output terminals;

(c) a plurality of pins projecting perpendicularly from said first end plate and conductively connected to said input terminals, said pins being adapted to engage said first electrical device;

(d) a second end plate contained within said housing having a plurality of conductive input and output terminals coincident with the terminals in said first end plate;

(e) a plurality of pin-socket pieces projecting perpendicularly from said second end plate adapted to engage the conductive leads of said second electrical device and each conductively connected to an output terminal of said second end plate;

(f) at least one switch assembly contained within said housing between said end plates, each switch assembly including a spacer having eyelets coincident with the terminals in the first end plate, a rotatable position selector partially contained within said spacer, a conductive spring wiper fixed to said position selector, said wiper having two indentations protruding from it, and a fixed contact assembly having a plurality of conductive input and output terminals coincident to the eyelets in said spacer, said fixed contact assembly also having input conductive areas conductively connected to one of said input terminals and output conductive areas each conductively paired with an output terminal in said fixed contact assembly; and (g) a plurality of bus pin conductors extending through said terminals and eyelets in said end plates and switch assemblies so as to permit transmission of an electrical signal from the first end plate through the switch assemblies to the second end plate when each said wiper is positioned so that its indentations contact an input conductive area and an output conductive area, and transmits the electrical signal from an input terminal to a selected output terminal.

12. A rotary switching device according to claim 11, wherein said housing includes a pair of diametrically opposed flanges extending along the inside length of the housing, and wherein said end plates and switch assemblies each include a pair of diametrically opposed grooves adapted to engage said flanges and hold said end plates and switch assemblies rigid within said housing.

13. A rotary switching device according to claim 11, wherein said housing includes a plurality of slots, and wherein each said rotatable position selector includes a handle extending through one of said slots to permit adjustment of said position selector.

14. A rotary switching device according to claim 11, including a housing cap terminating from one end of said housing, and a pin-guide insert fixed within said housing cap adapted to receive and support the pin-socket pieces.

15. A rotary switching device according to claim 14, including axis means extending centrally through said end plates and said switch assemblies and anchored in said pin-guide insert.

16. A rotary switching device according to claim 11, wherein said bus pin conductors have ribbed cross-sections to securely engage the terminals and eyelets in said end plates and switch assemblies.

17. A rotary switching device according to claim 11, wherein said rotatable position selector includes a pair of flanges along one side of said selector, and wherein said wiper includes a pair of prongs adapted to fit securely between said flanges and thereby fix the wiper to the selector.

* * * * *

UNITED STATES PATENT AND TRADEMARK OFFICE

CERTIFICATE OF CORRECTION

PATENT NO. : 4,158,114

DATED : June 12, 1979

INVENTOR(S) : David Butler and Frank Cichanski

It is certified that error appears in the above-identified patent and that said Letters Patent are hereby corrected as shown below:

Column 3, Line 33, "fist" should be --first--

Column 4, Line 40, "element" should be --detent--

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*